US010518396B2

(12) United States Patent
Chen et al.

(10) Patent No.: US 10,518,396 B2
(45) Date of Patent: Dec. 31, 2019

(54) DRIVE BLADE LUBRICATION ASSEMBLY AND POWERED FASTENER DRIVER CONTAINING THE SAME

(71) Applicant: TECHTRONIC INDUSTRIES COMPANY LIMITED, Tsuen Wan, New Territories (CN)

(72) Inventors: Xingxing Chen, Dongguan (CN); Jingfeng Zhou, Dongguan (CN); Liguo Ma, Dongguan (CN); Jinlin Zhou, Dongguan (CN)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 384 days.

(21) Appl. No.: 15/531,031

(22) PCT Filed: Dec. 23, 2014

(86) PCT No.: PCT/CN2014/094587
§ 371 (c)(1),
(2) Date: May 26, 2017

(87) PCT Pub. No.: WO2016/101117
PCT Pub. Date: Jun. 30, 2016

(65) Prior Publication Data

US 2017/0326715 A1 Nov. 16, 2017

(51) Int. Cl.
*B25C 1/04* (2006.01)
*B25C 1/00* (2006.01)
(Continued)

(52) U.S. Cl.
CPC ..... *B25C 1/04* (2013.01); *B25C 1/00* (2013.01); *B25C 1/001* (2013.01); *B25C 1/06* (2013.01);
(Continued)

(58) Field of Classification Search
CPC ..... B25C 1/04; B25C 1/041; B25C 1/047; B25C 1/06; B25C 1/008; B25C 1/14; B25C 1/18; B25C 5/13; B25C 5/15
(Continued)

(56) References Cited

U.S. PATENT DOCUMENTS 3,967,771 A * 7/1976 Smith ..... B25C 1/08 227/10
4,403,722 A * 9/1983 Nikolich ..... B25C 1/008 227/10
(Continued)

FOREIGN PATENT DOCUMENTS

| | | |
|---|---|---|
| DE | 3728454 | 3/1989 |
| EP | 1293302 | 3/2003 |
| WO | WO-0187545 A1 | 11/2001 |

OTHER PUBLICATIONS

Extended European Search Report for Application No. 1490868836 dated Nov. 23, 2017, 6 pages.
(Continued)

*Primary Examiner* — Scott A Smith
(74) *Attorney, Agent, or Firm* — Michael Best & Friedrich LLP

(57) ABSTRACT

A drive blade lubrication assembly for use in a powered fastener driver (10). The powered fastener driver (10) contains a drive blade (42) which snap-fits with a reciprocating piston (58) by a blade seal (103) assembly. The drive blade lubrication assembly contains a lubricant applying member adapted to apply lubricant to a portion of the drive blade (42); and a lubricant storing device which is in fluid communication with the lubricant applying member. The lubricating storing device is adapted to replenish the lubricant in the lubricant applying member. A powered fastener driver (10) containing a drive blade lubrication assembly is also described. The use of the lubricant storing device in the
(Continued)

present invention ensures that lubricant is continuously supplied to the drive blade (42) after long time usage of the powered fastener driver (10), so that friction between the drive blade and the blade seal assembly is minimized.

20 Claims, 5 Drawing Sheets

(51) Int. Cl.

| | |
|---|---|
| ***B25C 5/13*** | (2006.01) |
| ***B25C 1/06*** | (2006.01) |
| ***B25C 1/08*** | (2006.01) |
| ***B25C 1/12*** | (2006.01) |
| ***B25C 1/18*** | (2006.01) |
| *B25C 5/15* | (2006.01) |

(52) U.S. Cl.
CPC ..... *B25C 1/08* (2013.01); *B25C 1/123* (2013.01); *B25C 1/188* (2013.01); *B25C 5/13* (2013.01); *B25C 1/047* (2013.01); *B25C 5/15* (2013.01)

(58) Field of Classification Search
USPC ..... 227/9, 8, 10, 156, 130, 136, 142, 140; 123/46 SC, 46 R
See application file for complete search history.

(56) References Cited

U.S. PATENT DOCUMENTS

| | | | | |
|---|---|---|---|---|
| 4,522,162 | A * | 6/1985 | Nikolich | B25C 1/08 123/46 SC |
| 5,191,209 | A * | 3/1993 | Rodseth | G01V 8/12 250/229 |
| 5,873,508 | A * | 2/1999 | MacVicar | B25C 1/008 123/46 SC |
| 6,260,519 | B1 * | 7/2001 | Phillips | B25C 1/005 123/46 R |
| 8,302,831 | B2 * | 11/2012 | Taylor | B25C 1/08 227/10 |
| 2010/0258608 | A1 | 10/2010 | Porth | |
| 2011/0198381 | A1 * | 8/2011 | McCardle | B25C 1/047 227/8 |
| 2013/0299546 | A1 * | 11/2013 | Zhao | B25C 1/008 227/8 |
| 2014/0054350 | A1 * | 2/2014 | Pedicini | B25C 5/15 227/8 |
| 2014/0175143 | A1 * | 6/2014 | Vanstaan | B25C 1/08 227/9 |
| 2015/0053736 | A1 * | 2/2015 | Pomeroy | B25C 1/041 227/142 |

OTHER PUBLICATIONS

International Search and Written Opinion for Application No. PCT/CN2014/094587 dated Sep. 23, 2015 (7 pages).

* cited by examiner

DRIVE BLADE LUBRICATION ASSEMBLY AND POWERED FASTENER DRIVER CONTAINING THE SAME

FIELD OF THE INVENTION

The present invention relates to power tools, and more specifically to powered fastener drivers.

BACKGROUND OF THE INVENTION

There are various fastener drivers known in the art for driving fasteners (e.g., nails, tacks, staples, etc.) into a workpiece. These fastener drivers operate utilizing various means known in the art (e.g., compressed air generated by an air compressor, electrical energy, flywheel mechanisms). Among them, the fastener drivers using vacuum as the power source for driving the fasteners, are widely used nowadays which often contain a cylinder-piston structure where vacuum is formed in a portion of the cylinder and its pressure difference with other portions of the cylinder (e.g. in atmosphere pressure) causes the piston to move and drive the fasteners. In some of these fastener drivers there is mechanism for generating vacuum in the cylinder by using a second piston of which the reciprocal movement expels air from a portion of the cylinder, thus creating vacuum thereinside. However, existing pneumatic fastener drivers often do not have a blade lubrication mechanism for reducing the friction between the blade and the blade seal in the second piston.

SUMMARY OF THE INVENTION

In the light of the foregoing background, it is an object of the present invention to provide an alternate fastener driver with an effective blade lubrication mechanism.

Accordingly, the present invention, in one aspect, is a powered fastener driver containing a cylinder, a reciprocating piston configured within the cylinder to create a pressure differential, a drive blade at least partially accommodated in the cylinder and operable to drive a fastener upon a driving force resulted from the pressure differential; the drive blade passing though the reciprocating piston and slidable with respect to the latter. The power fastener driver further includes a blade seal assembly located in the reciprocating piston, a lubricant applying member adapted to apply lubricant to a portion of the drive blade; and a lubricant storing device which is in fluid communication with the lubricant applying member. The blade seal assembly snap-fits with the drive blade so that the drive blade is adapted to move relative to the reciprocating piston. The lubricating storing device is adapted to replenish the lubricant in the lubricant applying member.

Preferably, the lubricant applying member is a channel formed in the reciprocating piston which connects fluidly the lubricant storing device to the portion of the drive blade.

More preferably, the channel is aligned to be substantially perpendicular to a length of the drive blade which is encompassed by the blade seal assembly.

In another variation, the channel is shielded from the exterior of the reciprocating piston by a covering member.

In one implementation, the at least a portion of the covering member is superimposed with a dust blocking layer. When the portion of the covering member wears out, the dust blocking layer continues to block dusts in the exterior of the reciprocating piston from entering the channel.

In one implementation, the lubricant storing device is positioned in the reciprocating piston at a location separated from the blade seal assembly along a longitudinal direction of the drive blade.

In another implementation, the lubricant storing device is positioned at a location separated from the blade seal assembly along a radial direction of the reciprocating piston.

Preferably, the lubricant storing device is a hollow portion formed in the reciprocating piston which is capable of storing a volume of the lubricant.

More preferably, the lubricant is grease oil.

In another aspect of the invention, a drive blade lubrication assembly for use in a powered fastener driver is disclosed. The powered fastener driver includes a drive blade snap-fitting with a reciprocating piston by a blade seal assembly. The drive blade lubrication assembly further includes a lubricant applying member adapted to apply lubricant to a portion of the drive blade; and a lubricant storing device which is in fluid communication with the lubricant applying member. The blade seal assembly snap-fits with the drive blade so that the drive blade is adapted to move relative to the reciprocating piston. The lubricating storing device is adapted to replenish the lubricant in the lubricant applying member.

Preferably, the lubricant applying member is a channel formed in the reciprocating piston which connects the lubricant storing device to the portion of the drive blade.

More preferably, the channel is aligned to be substantially perpendicular to a length of the drive blade which is encompassed by the blade seal assembly.

In another variation, the channel is shielded from the exterior of the reciprocating piston by a covering member.

In one implementation, the at least a portion of the covering member is superimposed with a dust blocking layer. When the portion of the covering member wears out, the dust blocking layer continues to block dusts in the exterior of the reciprocating piston from entering the channel.

In one implementation, the lubricant storing device is positioned in the reciprocating piston at a location separated from the blade seal assembly along a longitudinal direction of the drive blade.

In another implementation, the lubricant storing device is positioned at a location separated from the blade seal assembly along a radial direction of the reciprocating piston.

Preferably, the lubricant storing device is a hollow portion formed in the reciprocating piston which is capable of storing a volume of the lubricant.

More preferably, the lubricant is grease oil.

There are many advantages provided by the present invention, one of which is that the solution used in the present invention effectively extends the life cycle of the nailer blade as compared to conventional designs in which no effective lubricant is in place after the initial grease has leaked out. In addition, the use of the lubricant storing device in the present invention ensures that lubricant is continuously supplied to the drive blade after long time usage of the powered fastener driver, so that friction between the drive blade and the blade seal assembly is minimized and the fasteners can be strike out by the maximum force even after a long time of use.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
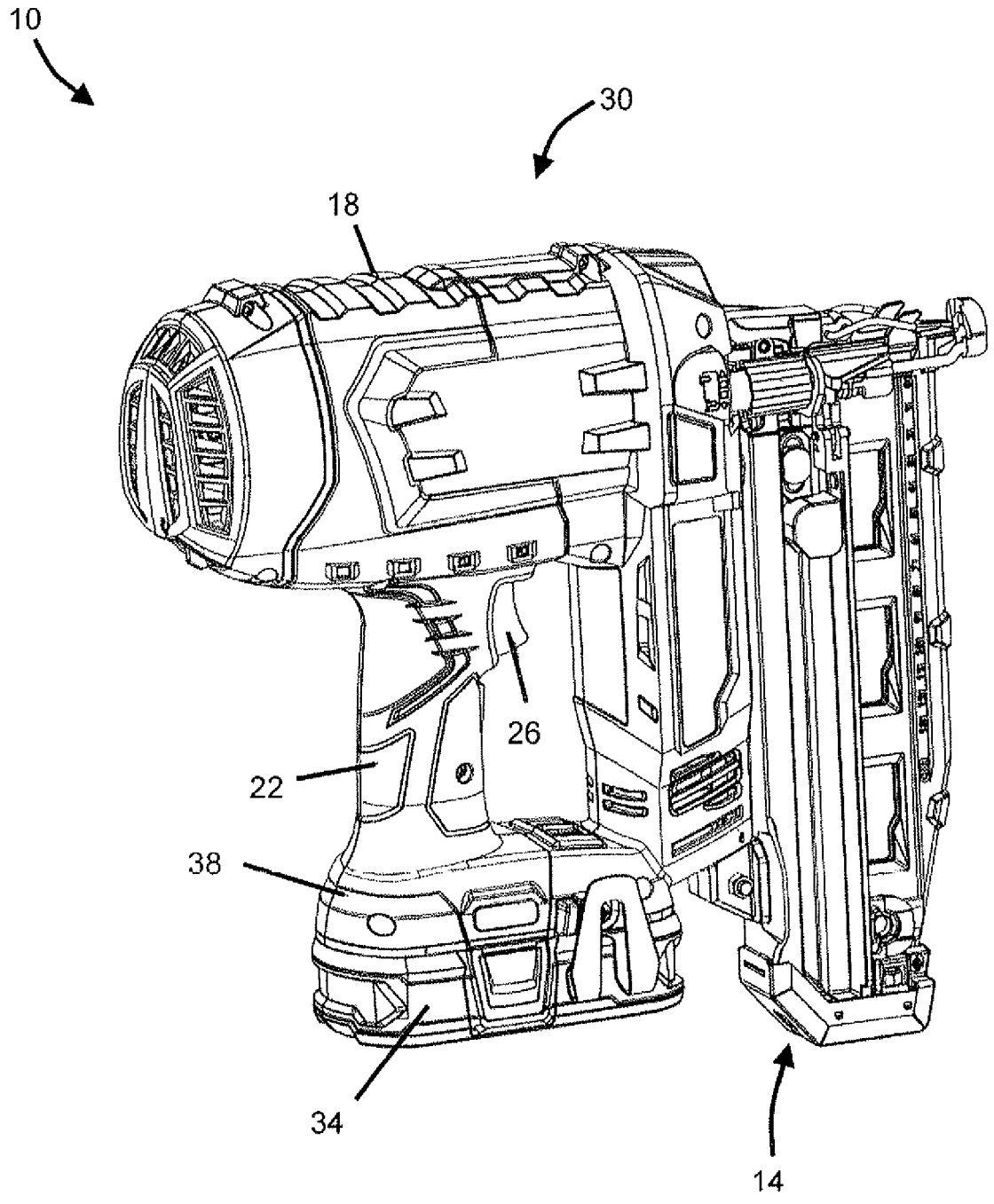
FIG. 1 is a perspective view of a powered fastener driver in accordance with an embodiment of the invention.

FIG. 1 illustrates the general structure of a vacuum powered fastener driver 10 according to the present invention, which is operable to drive fasteners (e.g., nails, tacks, staples, etc.) held within a magazine 14 into a workpiece. The fastener driver 10 includes an outer housing 18 with a handle portion 22, and a user-actuated trigger 26 mounted on the handle portion 22. The fastener driver 10 does not require an external source of air pressure, but rather includes an on-board vacuum system 30. The vacuum system 30 is powered by a power source (e.g., a battery pack 34), coupled to a battery attachment portion 38 of the outer housing 18. In alternative embodiments, alternative power sources (i.e., an electrical cord) may provide power to the vacuum system 30.

Figure 2:
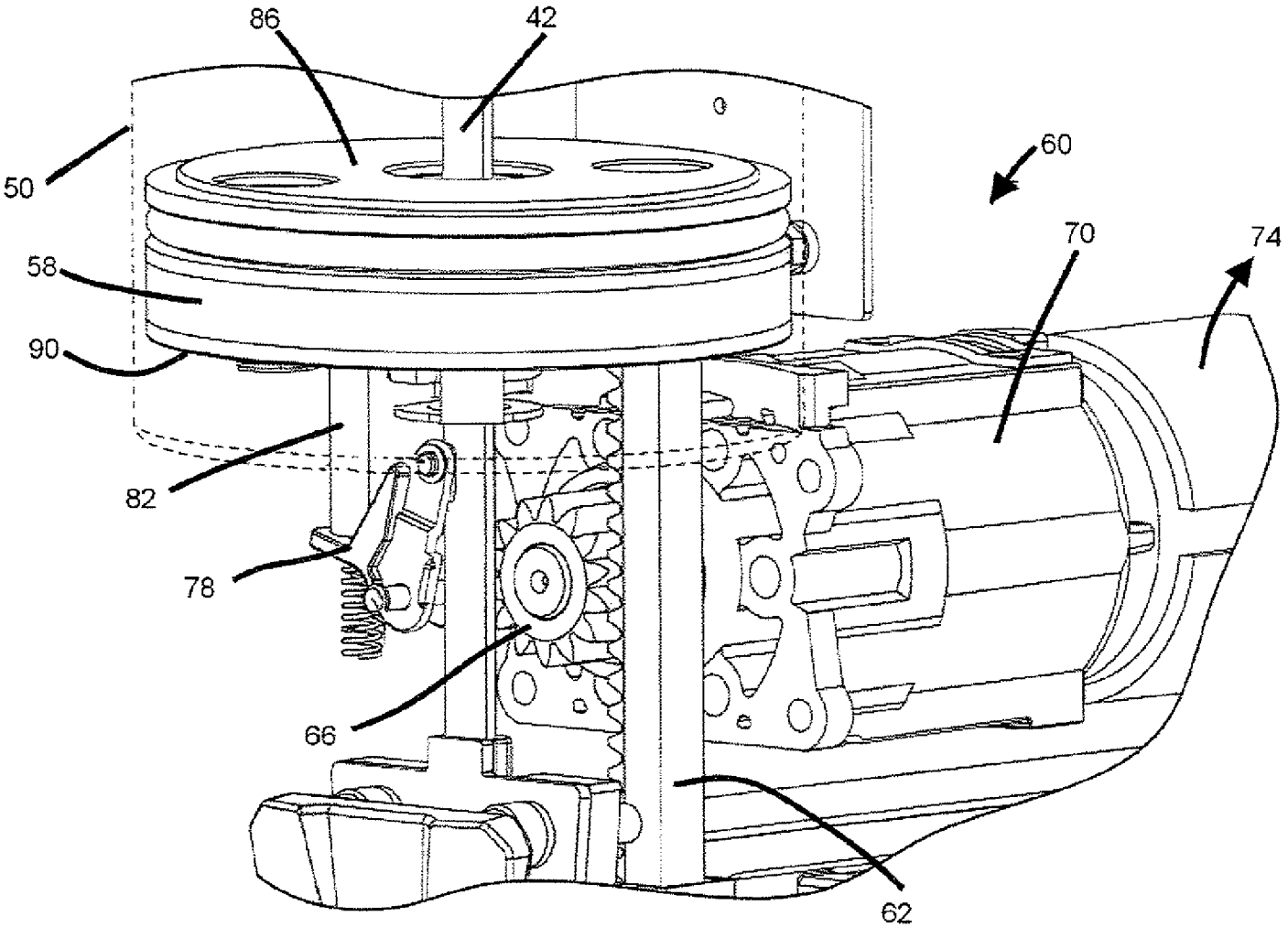
FIG. 2 is a perspective view of a drive assembly of the powered fastener driver of FIG. 1.

With reference to FIG. 2, the fastener driver 10 includes a drive blade 42 actuated by the vacuum system 30 to drive the fasteners into a workpiece. The vacuum system 30 includes a variable-volume vacuum chamber (not shown) defined within a cylinder 50, between a drive piston (not shown) and an elevator or a reciprocating piston 58. The drive blade 42 is coupled to the drive piston, and the vacuum chamber 46 creates a driving force as a result of differential pressure acting on the drive piston. The reciprocating piston 58 is driven in a reciprocating manner by a drive assembly 60. In the illustrated embodiment of the fastener driver 10, the drive assembly 60 includes a motor 74, a transmission 70 that receives torque from the motor, a pinion 66 drivably coupled to the output of the transmission 70, and a rack 62 meshed with the pinion 66 and connected to the drive piston for reciprocation therewith. A vacuum is developed within the vacuum chamber in the cylinder 50 by moving the reciprocating piston 58 away from the drive piston, while the position of the drive piston is held or maintained. A bumper (not shown) is positioned in a bottom portion of the cylinder 50 and absorbs impact forces from the reciprocating piston 58 and the drive piston.

In the above-mentioned embodiment, the drive blade is at its one end fixedly connected to the drive piston. On the other hand the drive blade snap-fits with the reciprocating piston. As a result, there is a blade seal assembly configured in the reciprocating piston of the fastener driver, which allows for slidably fit between the reciprocating piston and the drive blade, but also separates the vacuum in the vacuum chamber from the other portion of the cylinder, so as to maintain the pressure differential on the two sides. The blade seal is preferably movable between a first position, where the blade seal blocks an air leakage path and thus achieves airtight sealing, and a second position where the leakage path is unblocked and the sealing effect no longer exists. The change of the blade seal's position can be made by relative movement between the reciprocating piston and the drive blade. However, no matter which position the blade seal is located at, the blade seal always encompasses a certain portion of the drive blade while maintaining a generally tight, sliding fit between the blade seal and the drive blade. In the next part of the description, a drive blade lubrication assembly configured in the powered fastener drivers will be described which effectively introduces and maintains lubricant (such as grease oil) on the portion of the drive blade adjacent to the blade seal.

Figure 3:
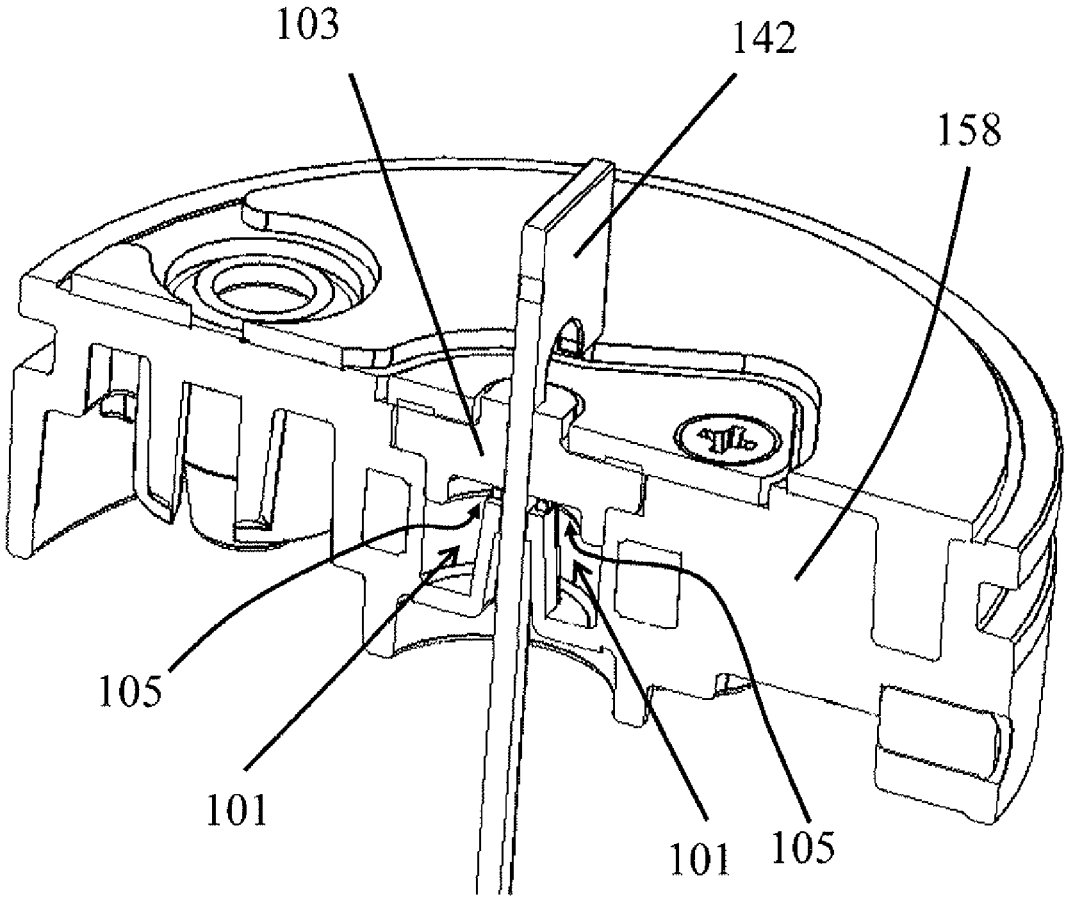
FIG. 3 shows the cross-sectional perspective view of the drive blade lubrication assembly in the powered fastener driver according to one embodiment of the present invention.

Turning now to FIG. 3, in one embodiment of the present invention there are grease pools 101 formed in the reciprocating piston 158. The grease pools 101 are hollow portions formed in the reciprocating piston 158, and each is capable of storing a volume of grease oil therein. As shown in FIG. 3, each grease pool 101 is formed with a trapezoidal cross-sectional shape, and two such grease pools 101 are symmetrically located on two side of the drive blade 142. The grease pools 101 are positioned in the reciprocating piston 158 at a location separated from a blade seal 103 along a longitudinal direction of the drive blade 142. In other words, the grease pools 101 are located adjacent to a portion of the drive blade 142 while the blade seal 103 is also located adjacent to the drive blade 142 but at a different point along the length of the drive blade 142. The blade seal 103 and the grease pools 101 are actually placed in a parallel manner along the length of the drive blade 142.

As shown in FIG. 3, there is also an outlet configured for each grease pool 101, which is a channel 105 connecting the grease pool 101 to a portion of the surface of the drive blade 142. The channel 105 as shown in this embodiment is aligned to be substantially perpendicular to a length of the drive blade 142 which is encompassed by said blade seal 103. The channel 105 is also referred as a lubricant applying member in this embodiment, since it functions to apply the lubricant to the surface of the drive blade 142. The grease pools 101 are also referred as lubricant storing devices in this embodiment, and the grease pools 101 are adapted to replenish lubricant in the channel 105 since each channel 105 is in fluid communication with its corresponding grease pool 101.

During continuous usage of the powered fastener driver, any grease oil originally applied on the surface of the drive blade (for example applied during manufacture of the fastener driver) will gradually leak out through the movement of the drive blade relative to the blade seal. In addition, the grease oil may gradually diffuse and thus leaves the blade surface. However, due to the presence of the grease pool, any loss of the grease oil on the drive blade will be replenished by that in the grease pool. The drive blade therefore can be always kept at the status where grease oil is present on the drive blade to reduce the friction between the blade and the blade seal. As a result, the performance of the powered fastener driver will not deteriorate over time because of depletion of the grease oil, and the fasteners will always be strike out by the powered fastener driver without any impedance resulted from friction between the blade and the blade seal.

Figure 4:
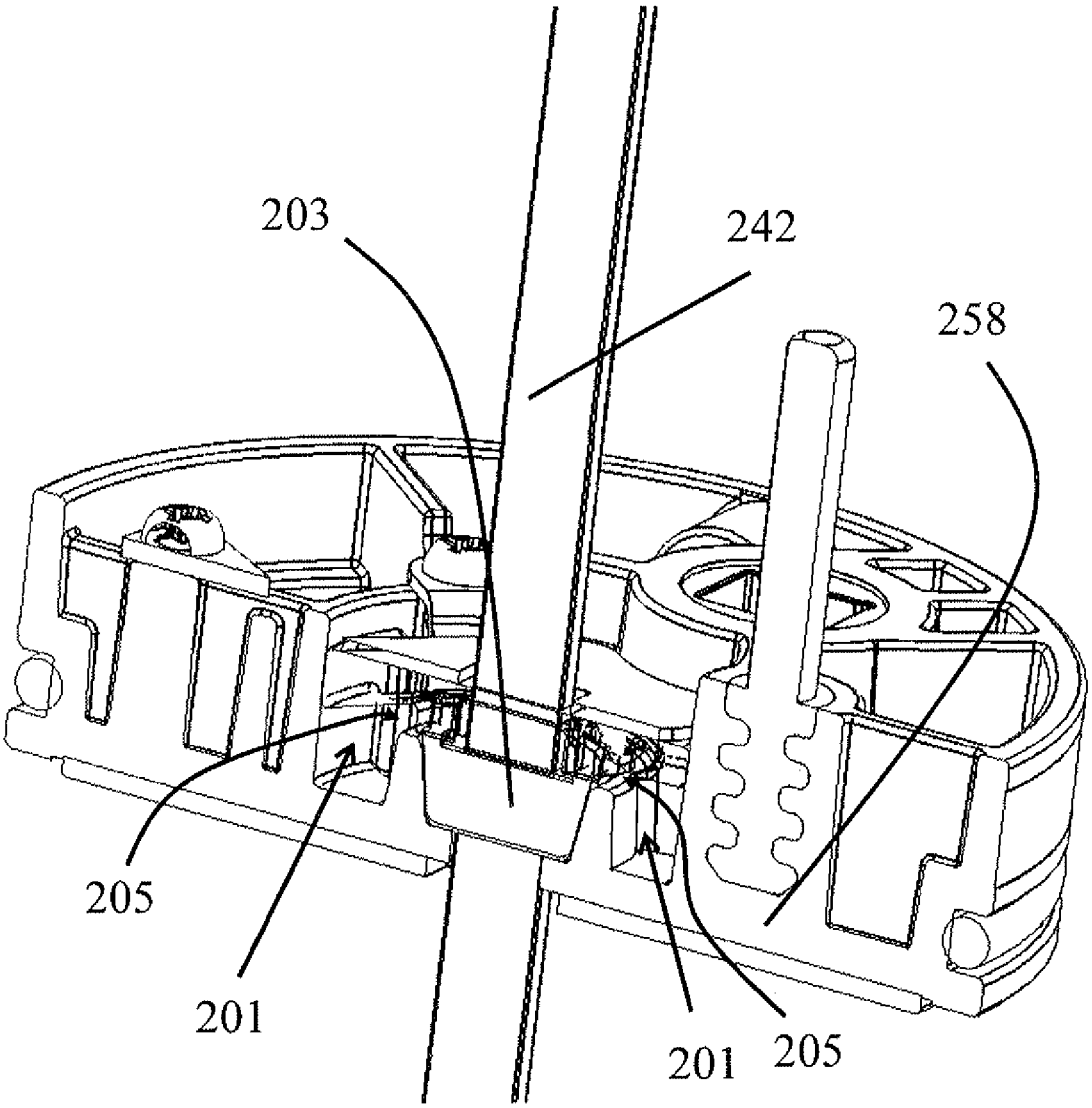
FIG. 4 shows the cross-sectional perspective view of the drive blade lubrication assembly in the powered fastener driver according to another embodiment of the present invention.

In another embodiment as illustrated in FIG. 4, the reciprocating piston 258 like that in FIG. 3 also contains a blade seal 203 where the drive blade 242 slidably fits with the blade seal 203. However, the difference of the reciprocating piston 258 compared to that in FIG. 3 is that the grease pools 201 are no longer placed adjacent to the drive blade 242 and separated from the blade seal 203 from a distance along the length of the drive blade 242. Rather, in FIG. 4 the grease pools 201 are placed on the exterior of the blade seal 203. That is to say, the grease pools 201 are positioned at locations separated from the blade seal 203 along a radial direction of the reciprocating piston 258. As a result, the channels 205 configured to fluidly connect the grease pools 201 to the portion of the drive blade 242 are longer than those shown in FIG. 3.

Figure 5:
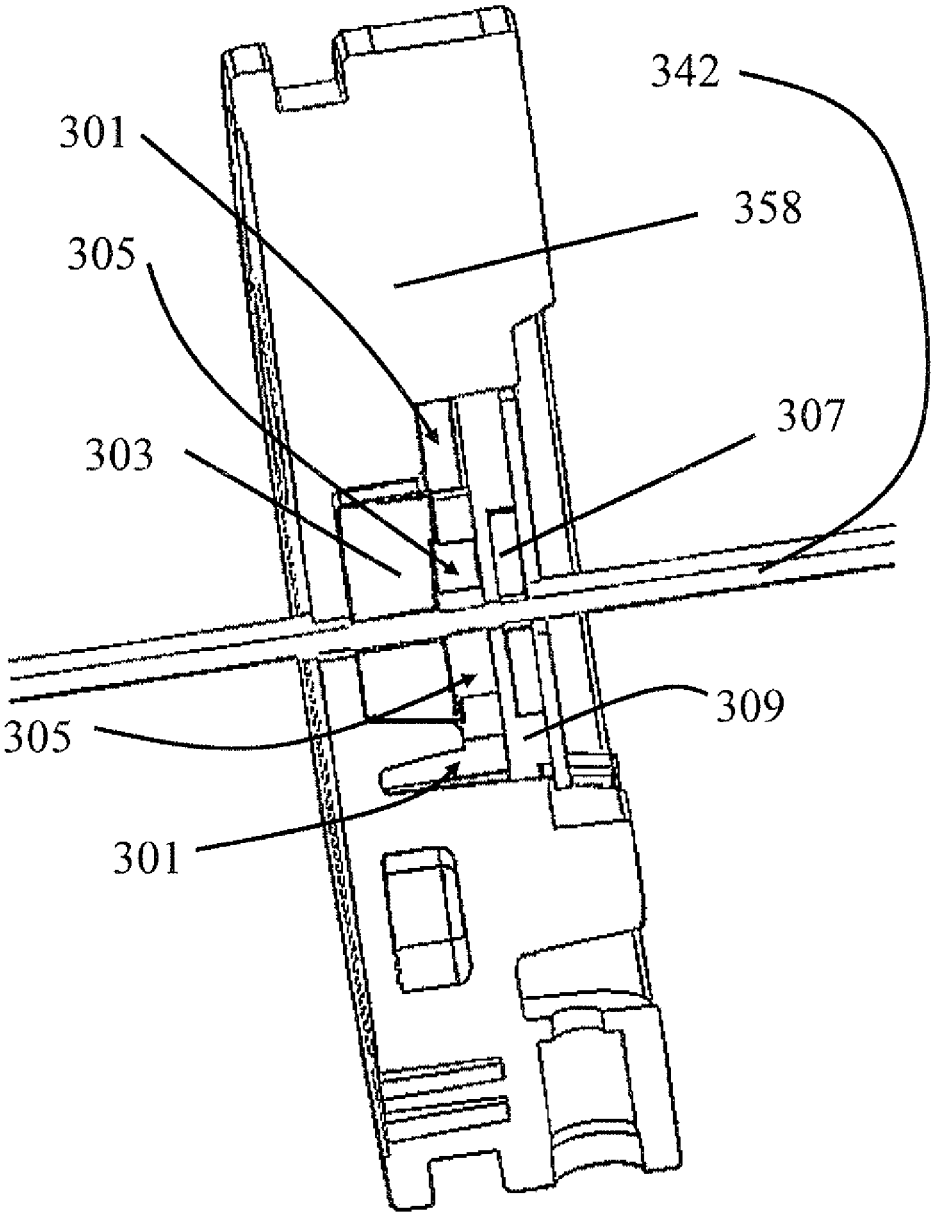
FIG. 5 shows the cross-sectional perspective view of the drive blade lubrication assembly in the powered fastener driver according to further embodiment of the present invention.

In another embodiment as illustrated in FIG. 5, the reciprocating piston 358 like that in FIG. 3 also contains a blade seal 303 where the drive blade 342 slidably fits with the blade seal 303. However, one can see that the grease pools 301 in this embodiment are placed substantially parallel to the channel 305, and each of the grease pools 301 is formed with a rectangular cross-sectional shape, with the length of the grease pool 301 being parallel to the radial direction of the reciprocating piston 358. What is more, the grease pools 301 and the channel 305 are covered by a dust covering member 309, which shields the channels 305 from the exterior of the reciprocating piston 358. The covering member 309 is preferably made of polyoxymethylene materials. There is further a blocking layer 307 placed outside the covering member 309. The covering member 309 is superimposed with the dust blocking layer 307, so that during use of the fastener driver when the portion of the covering member 309 near the interface of blade seal 303 and drive blade 342 wears out due to abrasion, the dust blocking layer 307 continues to block dusts in the exterior of the reciprocating piston 358 from entering the channel 305. The dust blocking layer 307 is preferably made of materials much harder than that of the covering member 309.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the above embodiment the lubricant used in the drive blade lubrication assembly is grease oil, although those skilled in the art would appreciate that any other types of liquid lubricant can also be used in the drive blade lubrication assembly of the present invention.

The invention claimed is:

1. A powered fastener driver comprising a cylinder, a reciprocating piston configured within said cylinder to create a pressure differential; a drive blade at least partially accommodated in said cylinder and operable to drive a fastener upon a driving force resulted from said pressure differential; said drive blade passing though said reciprocating piston and slidable with respect to the latter; wherein said power fastener driver further comprising:

a blade seal located in said reciprocating piston; said blade seal fitting with said drive blade so that said drive blade is adapted to move relative to said reciprocating piston;

a lubricant applying member adapted to apply lubricant to a portion of said drive blade; and a lubricant storing device which is in fluid communication with said lubricant applying member; said lubricating storing device adapted to replenish said lubricant in said lubricant applying member.

2. The powered fastener driver according to claim 1, wherein said lubricant applying member is a channel formed in said reciprocating piston which fluidly connects said lubricant storing device to said portion of said drive blade.

3. The powered fastener driver according to claim 2, wherein said channel is aligned to be substantially perpendicular to a length of said drive blade which is encompassed by said blade seal.

4. The powered fastener driver according to claim 2, wherein said channel is shielded from the exterior of said reciprocating piston by a covering member.

5. The powered fastener driver according claim to 4, wherein said at least a portion of said covering member is superimposed with a dust blocking layer; when said portion of said covering member wears out, said dust blocking layer continuing to block dusts in said exterior of said reciprocating piston from entering said channel.

6. The powered fastener driver according to claim 1, wherein said lubricant storing device is positioned in said reciprocating piston at a location separated from said blade seal along a longitudinal direction of said drive blade.

7. The powered fastener driver according to claim 1, wherein said lubricant storing device is positioned at a location separated from said blade seal along a radial direction of said reciprocating piston.

8. The powered fastener driver according to claim 1, wherein said lubricant storing device is a hollow portion formed in said reciprocating piston which is capable of storing a volume of said lubricant.

9. The powered fastener driver according to claim 1, wherein said lubricant is grease oil.

10. A drive blade lubrication assembly for use in a powered fastener driver, the powered fastener driver comprising a drive blade fitting with a reciprocating piston by a blade seal; said drive blade lubrication assembly comprising:

a lubricant applying member adapted to apply lubricant to a portion of said drive blade; and a lubricant storing device which is in fluid communication with said lubricant applying member; said lubricating storing device adapted to replenish said lubricant in said lubricant applying member.

11. The drive blade lubrication assembly according to claim 10, wherein said lubricant applying member is a channel formed in said reciprocating piston which fluidly connects said lubricant storing device to said portion of said drive blade.

12. The drive blade lubrication assembly according to claim 11, wherein said channel is aligned to be substantially perpendicular to a length of said drive blade which is encompassed by said blade seal.

13. The drive blade lubrication assembly according to claim 11, wherein said channel is shielded from the exterior of said reciprocating piston by a covering member.

14. The drive blade lubrication assembly according to claim 13, wherein said at least a portion of said covering member is superimposed with a dust blocking layer; when said portion of said covering member wears out, said dust blocking layer continuing to block dusts in said exterior of said reciprocating piston from entering said channel.

15. The drive blade lubrication assembly according to claim 10, wherein said lubricant storing device is positioned in said reciprocating piston at a location separated from said blade seal along a longitudinal direction of said drive blade.

16. The drive blade lubrication assembly according to claim 10, wherein said lubricant storing device is positioned at a location separated from said blade seal along a radial direction of said reciprocating piston.

17. The drive blade lubrication assembly according to claim 10, wherein said lubricant storing device is a hollow portion formed in said reciprocating piston which is capable of storing a volume of said lubricant.

18. The drive blade lubrication assembly according to claim 10, wherein said lubricant is grease oil.

19. A powered fastener driver comprising:

a cylinder;

a reciprocating piston within the cylinder;

a seal positioned within the reciprocating piston;

a drive blade operable to drive a fastener, the drive blade extending through the seal and slidable with respect to the reciprocating piston;

a reservoir defined in the reciprocating piston containing a lubricant therein; and a channel extending between the reservoir and the drive blade to direct lubricant toward the drive blade.

20. The powered fastener driver of claim 19, further comprising a dust cover at least partially defining the channel.

* * * * *